US007554514B2

(12) United States Patent
Nozawa

(10) Patent No.: US 7,554,514 B2
(45) Date of Patent: Jun. 30, 2009

(54) ELECTRO-OPTICAL DEVICE AND ELECTRONIC APPARATUS

(75) Inventor: Toshiyuki Nozawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 815 days.

(21) Appl. No.: 11/079,173

(22) Filed: Mar. 15, 2005

(65) Prior Publication Data

US 2005/0225683 A1 Oct. 13, 2005

(30) Foreign Application Priority Data

Apr. 12, 2004 (JP) ..... 2004-116778

(51) Int. Cl.
*G09G 3/32* (2006.01)

(52) U.S. Cl. ..... 345/82; 345/76

(58) Field of Classification Search ..... 345/75.2, 345/76–83, 204; 315/169.1, 169.3; 313/483
See application file for complete search history.

(56) References Cited

U.S. PATENT DOCUMENTS 6,392,617 B1 * 5/2002 Gleason ..... 345/82
6,404,137 B1 * 6/2002 Shodo ..... 315/169.1
6,542,138 B1 4/2003 Shannon et al.
6,633,301 B1 * 10/2003 Dallas et al. ..... 345/597
7,061,452 B2 * 6/2006 Inoue et al. ..... 345/76
7,276,961 B2 * 10/2007 Kimura ..... 327/538
7,321,348 B2 * 1/2008 Cok et al. ..... 345/82
7,348,946 B2 * 3/2008 Booth et al. ..... 345/82
2002/0171611 A1 * 11/2002 Cok ..... 345/82
2004/0222954 A1 * 11/2004 Lueder ..... 345/87
2006/0038758 A1 * 2/2006 Routley et al. ..... 345/81

FOREIGN PATENT DOCUMENTS

JP A 2003-509728 3/2003

OTHER PUBLICATIONS

Fish et al., "35.2: Improved Optical Feedback for AMOLED Display Differential Ageing Compensation,"SID 04 Digest, vol. XXXV, Book II, pp. 1120-1123, May 26-27, 2004.

* cited by examiner

*Primary Examiner*—Ricardo L Osorio
(74) *Attorney, Agent, or Firm*—Oliff & Berridge, PLC

(57) ABSTRACT

To ensure uniformity of display regardless of a characteristics difference and temporal deterioration of a light-emitting element. An optical feedback type pixel circuit having a photoelectric transducer therein comprises a capacitor C1 for storing as an electric charge an integral value of the photoelectric current output from the photoelectric transducer; a comparator for changing a level of an output voltage Vout at a timing when a first voltage set according to the electric charge stored in the capacitor C1 reaches a second voltage set according to data supplied through a data line X; and a transistor T2 electrically controlled according to the output voltage Vout from the comparator for making an organic EL element OLED emit light when the first voltage has not reached the second voltage and for making the organic EL element OLED stop emitting the light when the first voltage reaches the second voltage.

8 Claims, 11 Drawing Sheets

ELECTRO-OPTICAL DEVICE AND ELECTRONIC APPARATUS

BACKGROUND

The present invention relates to a method of driving a pixel circuit, a pixel circuit, an electro-optical device and an electronic apparatus, and more particularly, to an optical feedback type pixel circuit having a built-in photoelectric transducer built.

Recently, a flat panel display (FPD) using an organic EL (electronic luminescence) element has been drawing attention. The organic EL element is an example of current-driven elements driven by a driving current flowing therein to emit light with a brightness corresponding to the current level. In an organic EL display, the difference in the characteristics of the organic EL element (particularly, current-brightness characteristic) adversely influences the uniformity of display. Further, it has been known that the organic EL element has a large degree of temporal degradation as compared to an element made of other materials such as liquid crystal. For this reason, in the organic EL display, the degree of degradation between the elements is varied according to the displayed images, so that burn-in is easily generated in the screen.

In order to solve these problems, Patent Document 1 proposed an optical feedback type pixel circuit having a photoelectric transducer built therein. The pixel circuit includes a driving transistor for supplying a driving current to a light-emitting element, a capacitor for applying a gate voltage to the driving transistor, and a photoelectric transducer connected in parallel to the capacitor for receiving a photoelectric current according to the intensity of the received light. The photoelectric transducer generates a photoelectric current according to the intensity of the received light. The electric charge stored as data in a capacitor is discharged according to the photoelectric current. In a light-emitting element having a high light-emitting efficiency and high brightness, since the photoelectric current is large, the light emitting attenuates relatively fast. On the other hand, in a light-emitting element having a low light-emitting efficiency and low brightness, since the photoelectric current is small, the light emitting attenuates relatively slow. As a result, even though the characteristics of the light-emitting elements are different, since the integral value of the brightness in the overall one frame is substantially the same, the difference in characteristics of the light-emitting elements is compensated.

[Patent Document 1] Japanese Unexamined Patent Application Publication No. 2003-509728

SUMMARY

However, in the above-mentioned conventional art, it is difficult to reliably ensure the uniformity of display. This is because the pixel circuit is easily affected by the difference in the characteristics of the driving transistors. A threshold voltage Vth of the driving transistors is different for each element. For this reason, in a case of the same gradation, the off timing is different in every driving transistor and the timing when the light-emitting elements are stopped from lighting is different. As a result, even in the case of the same gradation, the difference in the brightness is caused, and the uniformity of display is lowered. Particularly, the uniformity of display is remarkably lowered in a low gradation region. In the low gradation region, since the S/N of the light receiving element is lowered due to leaks, the control through the feedback is deteriorated. In the conventional art, since the brightness of the light-emitting elements temporally decreases according to the discharge of the capacitor, even the region of the light receiving element having bad S/N should be used.

Accordingly, the present invention is designed to solve the above-mentioned problems, and it is an object of the present invention to provide an optical feedback type pixel circuit capable of ensuring uniformity of display regardless of the difference in characteristics of light-emitting elements and the temporal deterioration.

In order to solve the above-mentioned problems, according to a first aspect of the present invention, there is provided a pixel circuit comprising: a light-emitting element for emitting light according to a driving current supplied through a predetermined path; a photoelectric transducer for receiving the light emitted from the light-emitting element to output a photoelectric current according to the received light; a first capacitor for storing as an electric charge the integral value of the photoelectric current output from the photoelectric transducer; a comparator for changing a level of an output voltage at a timing when a first voltage set according to the electric charge stored in the first capacitor reaches a second voltage set according to data supplied through a data line; and a first switching element electrically controlled according to the output voltage output from the comparator for making the light-emitting element emit the light when the first voltage has not reached the second voltage and for making the light-emitting element stop emitting the light when the first voltage reaches the second voltage.

According to the first aspect, the first switching element is provided in the middle of a path for supplying a driving current to the light-emitting element, to form the path of the driving current when the first voltage has not reached the second voltage and to cut off the path of the driving current when the first voltage reaches the second voltage.

According to the first aspect, the pixel circuit may further comprise a second capacitor for storing the data supplied through the data line; and a driving transistor having its gate connected to the second capacitor for generating the driving current according to the data stored in the second capacitor. In this case, the first switching element is provided in parallel with the second capacitor, to electrically separate a pair of electrodes of the second capacitor from each other when the first voltage has not reached the second voltage and to electrically connect the pair of electrodes of the second capacitor to each other when the first voltage reaches the second voltage.

According to the first aspect, the pixel circuit may further comprise a second switching element provided between a node to which the photoelectric transducer and the first capacitor are commonly connected and a voltage terminal supplied with a predetermined reset voltage, and for resetting the electric charge stored in the first capacitor using the reset voltage.

According to the first aspect, the pixel circuit may further comprise a source follower circuit provided between a node to which the photoelectric transducer and the first capacitor are commonly connected and an input node of the comparator.

According to a second aspect of the present invention, there is provided an electro-optical device comprising: a plurality of scanning lines; a plurality of data lines; a plurality of pixel circuits provided at intersections of the plurality of scanning lines and the plurality of data lines; a scanning line driving circuit for sequentially selecting the plurality of scanning lines; and a data line driving circuit operating in conjunction with the scanning line driving circuit for outputting a data voltage to the plurality of data lines. Here, the pixel circuit is the above-mentioned pixel circuit according to the first aspect of the present invention.

According to a third aspect of the present invention, there is provided an electronic apparatus having the electro-optical device according to the second aspect.

According to a fourth aspect of the present invention, there is provided a method of driving a pixel circuit comprising: a first step of supplying a driving current to a light-emitting element through a predetermined path to make the light-emitting element emit light; a second step of receiving the light emitted from the light-emitting element to output a photoelectric current according to the received light from a photoelectric transducer; a third step of storing as an electric charge in a first capacitor the integral value of the photoelectric current output from the photoelectric transducer; a fourth step of changing a level of the output voltage output from a comparator at a timing when a first voltage set according to the electric charge stored in the first capacitor reaches a second voltage set according to data supplied through a data line; and a fifth step of electrically controlling a first switching element according to the output voltage output from the comparator, to make the light-emitting element emit the light when the first voltage has not reached the second voltage and to make the light-emitting element stop emitting the light when the first voltage reaches the second voltage.

According to the fourth aspect, the first switching element is provided in the middle of a path for supplying a driving current to the light-emitting element. In this case, the fifth step comprises a step of forming the path of the driving current by turning on the first switching element when the first voltage has not reached the second voltage; and a step of cutting off the path of the driving current by turning off the first switching element when the first voltage reaches the second voltage.

According to the fourth aspect, the first step comprises a step of writing data supplied through the data line in a second capacitor; a step of modulating the driving current according to the data stored in the second capacitor; and a step of supplying the modulated driving current to the light-emitting element through the predetermined path to make the light-emitting element emit the light.

[Effect of the Invention]

According to the present invention, the integral value of the photoelectric current output from the photoelectric transducer is stored as the electric charge of the first capacitor, and the light emitting of the light-emitting element is stopped at the timing when the first voltage reaches the second voltage. As a result, since a total amount of the light emitted from the light-emitting element is programmable, it is possible to ensure uniformity of display regardless of the characteristics difference or temporal deterioration of the light-emitting element.

DETAILED DESCRIPTION OF EMBODIMENTS

First Embodiment

Figure 1:
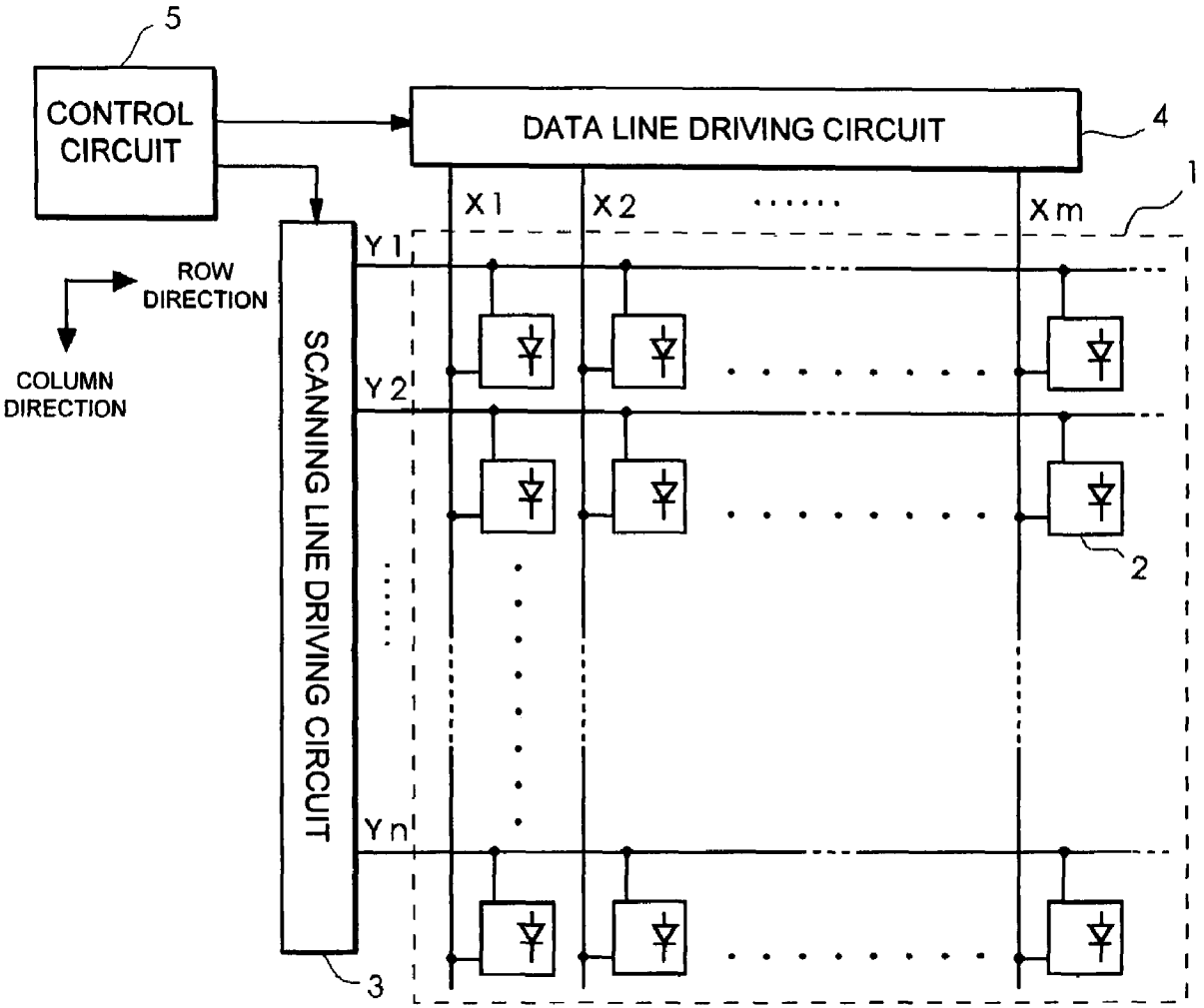
FIG. 1 is a block diagram showing a structure of an electro-optical device.

FIG. 1 is a block diagram showing a structure of an electro-optical device according to a first embodiment of the present invention. A display unit 1 is an active matrix type display panel in which a light-emitting element is driven by a TFT (thin film transistor), for example. In the display unit 1, a group of pixels in m dots×n lines are arranged in a matrix (in a two-dimensional manner). In the display unit 1, a plurality of scanning lines Y1 to Yn each extending in a horizontal direction and a plurality of data lines X1 to Xm each extending in a vertical direction are provided, and a pixel 2 (pixel circuit) is arranged at each of intersections of the scanning lines and the data lines. In addition, from the relationship with each pixel circuit that is described later, one scanning line Y shown in FIG. 1 indicates a set of a plurality of scanning lines.

A control circuit 5 generates various internal signals on the basis of an external signal received from a high ranked device (not shown) and synchronously controls a scanning line driving circuit 3 and a data line driving circuit 4 based on the various internal signals. Under the synchronous control, the scanning line driving circuit 3 and the data line driving circuit 4 cooperates with each other to perform the display control of the display unit 1. The scanning line driving circuit 3 is mainly composed of a shift register, an output circuit or the like and outputs the scanning signals to the scanning lines Y1 to Yn. The scanning signal has two signal levels such as a high potential level (hereinafter, referred to as 'H level') and a low potential level (hereinafter, referred to as 'L level'). The scanning line Y corresponding to a row of pixels in which data is written is set to H level, and the scanning line Y corresponding to the rest of rows of pixels is set to L level. The scanning line driving circuit 3 performs a line-sequential scanning which sequentially selects each scanning line Y in predetermined selection order (generally, in an order from the uppermost line to the lowermost line) for every one frame (1F) corresponding to a display period of one image. On the other hand, the data line driving circuit 4 is mainly composed of a shift register, a line latch circuit, an output circuit or the like. The data line driving circuit 4 simultaneously performs a simultaneous output of the data voltage Vdata for a row of pixels in which current data is written during one horizontal scanning period (1H) corresponding to a period for selecting one scanning line Y, and a dot-sequential latch of the data for the row of pixels in which data is written during a next 1H. During one 1H, m data corresponding to the number of lines of the data line X is sequentially latched. During the next 1H, the latched m data are converted into the data voltage Vdata by the voltage DAC to be simultaneously output to the corresponding data lines X1 to Xm.

Figure 2:
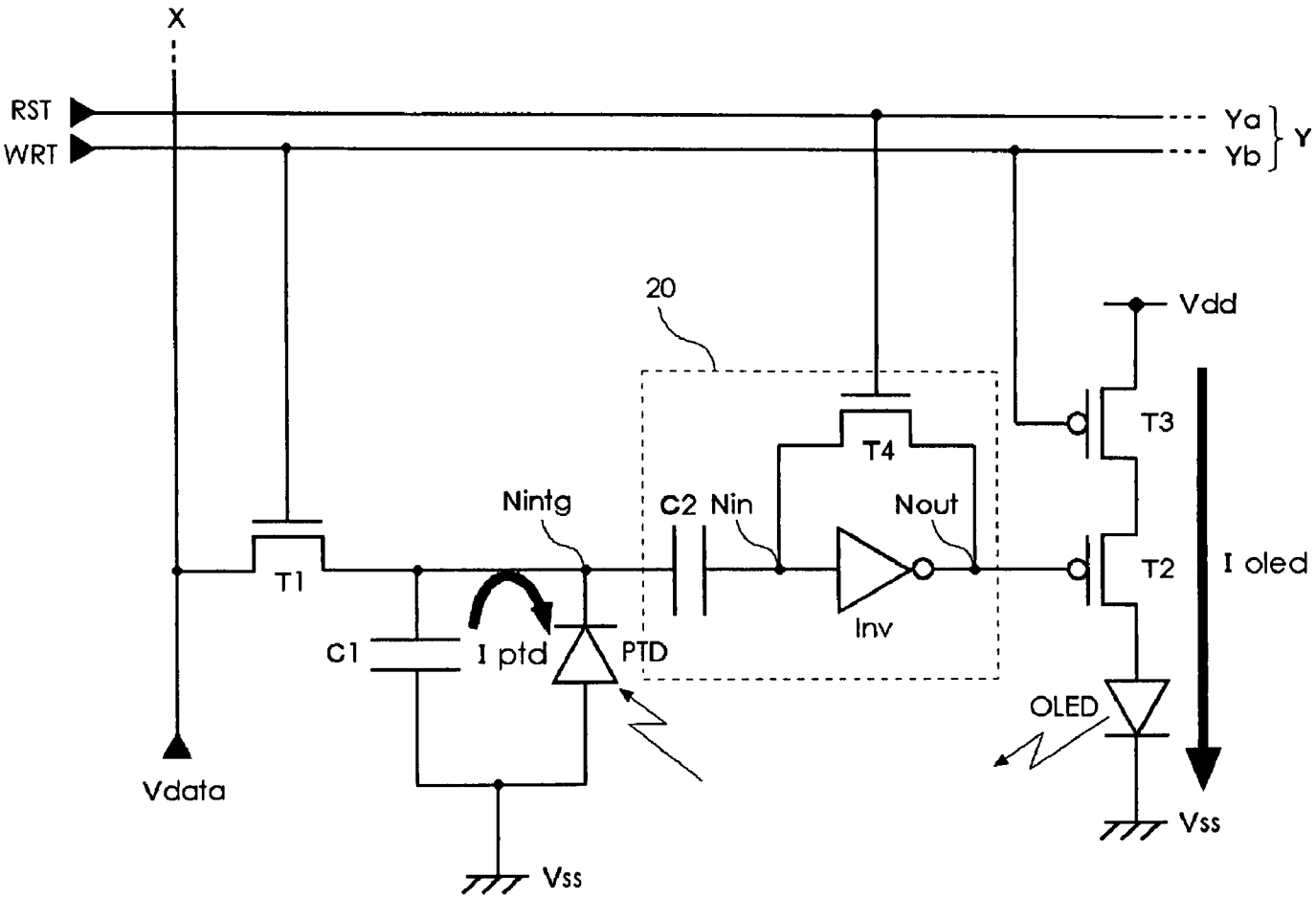
FIG. 2 is a pixel circuit diagram according to a first embodiment of the present invention.

FIG. 2 is a diagram showing an optical feedback type pixel circuit according to the first embodiment of the present invention. The scanning line Y of one line shown in FIG. 1 corresponds to a set of two scanning lines Ya and Yb shown in FIG. 2. The pixel circuit comprises an organic EL element OLED serving as a light-emitting element, four transistors T1 to T4, two capacitors C1 and C2, an inverter INV, and a photoelectric transducer PTD. The organic EL element OLED indicated by a diode is a typical current-driven light-emitting element of which a brightness is set according to the current flowing therein. According to the present embodiment, a photodiode for outputting a photoelectric current proportional to the intensity of an incident light is used as the photoelectric transducer PTD. The photodiode may be a PN diode, a PIN diode, a Schottky diode, an organic photodiode (or organic EL element), a photodiode using the TFT, and a various diode using an amorphous silicon and a polysilicon. In the configuration of FIG. 2, the transistors T2 and T3 are p channel-type transistors and the other transistors are n channel-type transistors. However, this configuration is only one example, and other configurations may be used. In the present specification, with regard to a transistor serving as a three-terminal element having a source, a drain and a gate, one of the source or the drain is called a 'one terminal' and the other of the source or the drain is called 'the other terminal'.

A gate of the transistor T1 serving as a switching element is connected to a second scanning line Yb supplied with a write signal WRT serving as one scanning signal. One terminal of the transistor T1 is connected to a data line X supplied with the data voltage Vdata (and a reset voltage Vrst which is described later) and the other terminal is connected to an integrating node Nintg. The integrating node Nintg is commonly connected to one electrode of a capacitor C1 and a cathode of a photodiode PTD and is connected to one electrode of a capacitor C2 constituting a part of a comparator 20. The other electrode of the capacitor C1 is connected to an anode of the photodiode PTD connected in parallel to the capacitor C1 and is connected to a Vss terminal to which a reference voltage Vss lower than a power supply voltage Vdd is normally supplied.

Figure 11:
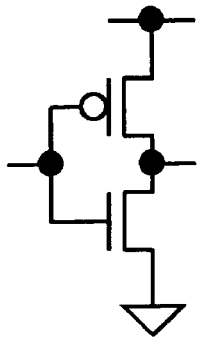
FIG. 11 is a circuit diagram of an inverter having a CMOS structure.

According to the present embodiment, as the comparator 20, a chopper type comparator which is composed of the capacitor C2, the inverter INV and the transistor T4 is used. An input node Nin of the inverter INV is commonly connected to the other electrode of the capacitor C2 and one terminal of the transistor T4 serving as a switching element. A gate of the transistor T4 is connected to a first scanning line Ya supplied with a reset signal RST serving as the other scanning signal and the other terminal of the transistor T4 is connected to an output node Nout of the inverter INV. The transistor T4 short-circuits the input node Nin and output node Nout of the inverter by an electrical conduction control through a reset signal RST. In addition, the inverter INV may have any one of a CMOS configuration in which the p channel-type transistor is combined with the n channel-type transistor, an NMOS configuration in which an active load is added or an MOS configuration in which a resistor is added. FIG. 11 is a circuit diagram of an inverter having the CMOS configuration.

The output node Nout of the inverter INV is connected to the gate of the transistor T2 serving as the switching element. One terminal of the transistor T2 is connected to the anode of the organic EL element OLED. The cathode of the organic EL element OLED is connected to the Vss terminal. In addition, the other terminal of the transistor T2 is connected to one terminal of the transistor T3. The other terminal of the transistor T3 is connected to the Vdd terminal to which the power supply voltage Vdd is normally supplied and its gate is connected to the second scanning line Yb.

Figure 3:
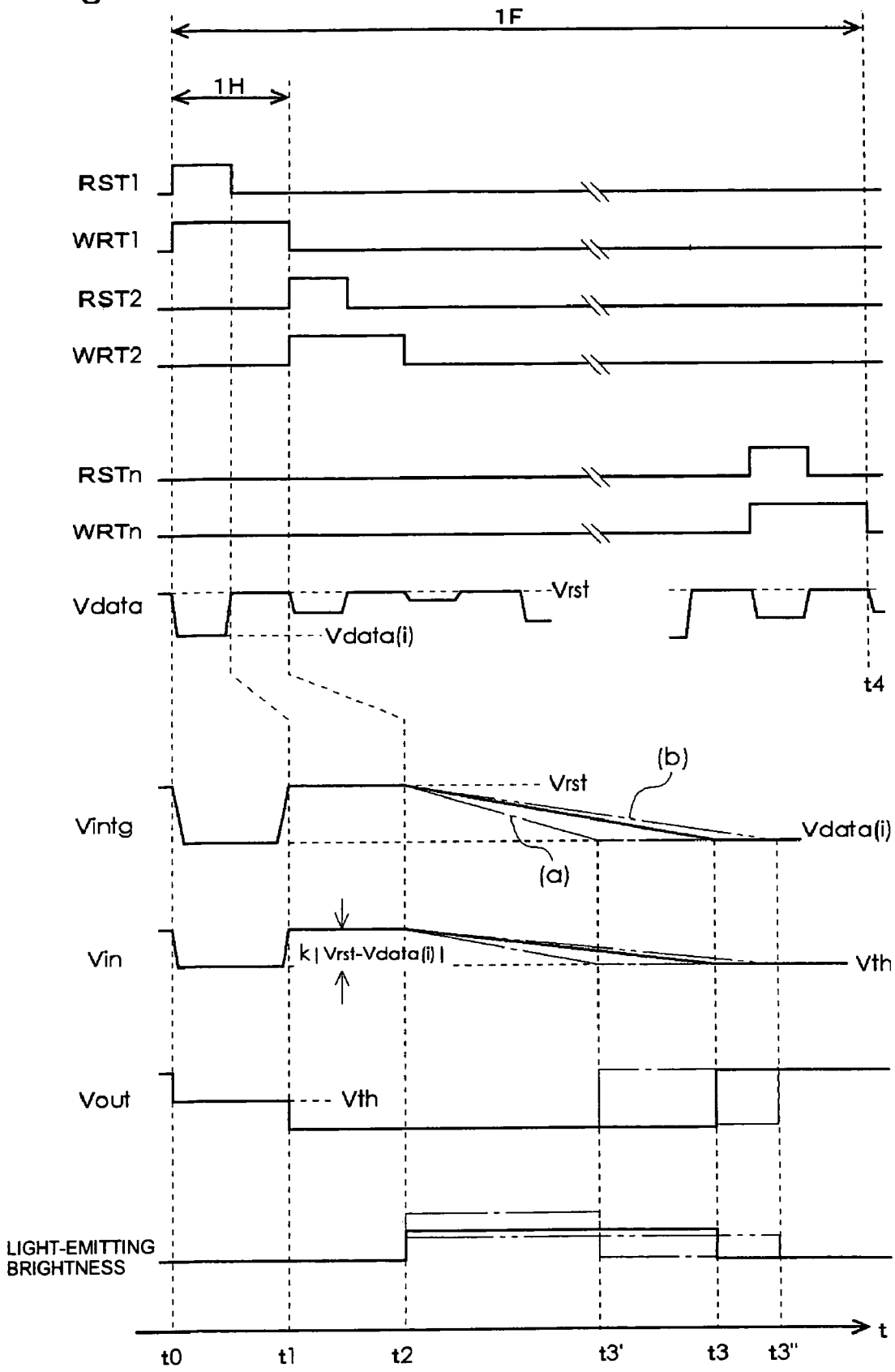
FIG. 3 is an operation timing chart according to a first embodiment of the present invention.

FIG. 3 is an operation timing chart of the pixel circuit shown in FIG. 2. A series of operation process at periods t0 to t4 corresponding to the 1F described above is largely divided into three processes, that is, a data writing process at the period t0 to t1, a reset process at the period t1 to t2, and a driving process at the period t2 to t4.

First, the overall display process of the display unit 1 will be schematically described before the operation process of the pixel circuit is described. The scanning line driving circuit 3 first selects the scanning line Y1 (=Ya and Yb) corresponding to the uppermost row of pixels among the scanning line group Y1 to Yn during the period t0 to t2 corresponding to the first 1H. As a result, with regard to the scanning line Y1, a write signal WRT1 serving as one scanning signal is set to H level over the overall 1H (that is, the period t0 to t2). In addition, a reset signal RST1 serving as the other scanning signal is set to H level during the data writing period t0 to t1 corresponding to the first half of the 1H and is set to L level at the reset period t1 to t2 corresponding to the second half of the 1H. The data line driving circuit 4 simultaneously outputs m data voltages Vdata (i)(i=1) corresponding to the uppermost row of pixels to the data lines X1 to Xm, in synchronization with the selection of the scanning line Y1 by the scanning line driving circuit 3. However, the data voltage Vdata (i) is output only for the data writing period t0 to t1, and a predetermined reset voltage Vrst is output during the reset period t1 to t2 of the second half. The display gradation of the pixel 2 is defined by the electric potential difference |Vrst−Vdata(i)| between the reset voltage Vrst and the data voltage Vdata (i), and the brightness increases when the electric potential difference increases.

During the next 1H, the scanning line driving circuit 3 selects the second scanning line Y2. As a result, with regard to the scanning line Y2, the write signal WRT 2 is set to H level for the overall 1H, and the reset signal RST2 is set to H level only for the first half of the 1H. The data line driving circuit 4 simultaneously outputs m data voltages Vdata (i)(i=2) corresponding to the second row of pixels to the data lines X1 to Xm, in synchronization with the selection of the scanning line Y2 by the scanning line driving circuit. Hereinafter, the scanning lines Y3, Y4, . . . , and Yn are sequentially selected for every 1H until it reaches the lowermost scanning line Yn, and the data voltage Vdata (i) (i=3, 4, . . . , and n) corresponding to the row of pixels according to the selected scanning line is repeatedly output.

Next, the operation process of the pixel circuit will be described by using a pixel circuit selected by the scanning signals RST1 and the WRT1 as an example. First, during the data writing period t0 to t1, the writing of the data to the capacitor C2 and the reset of the comparator 20 are performed. Specifically, the level of the reset signal RST1 becomes H level and the transistor T4 provided in the comparator 20 is turned on. As a result, the input and output nodes Nin and Nout of the inverter INV are short-circuited and the input and output voltages Vin and Vout are set to an inversion threshold value Vth (≈½ Vdd) of the inverter INV. In addition, the level of the write signal WRT1 becomes H level and the transistor T1 is turned on. During the period t0 to t1, the data voltage Vdata (i) supplied to the data line X is supplied to the integrating node Nintg, to which the capacitors C1 and C2 are connected, through the transistor T1 which is turned on. As a result, the electric charge corresponding to the electric potential difference |Vdata(i)−Vss| between the integrating node Nintg (Vintg=Vdata(i)) and the Vss terminal is stored in the capacitor C1. However, the electric charge stored in the capacitor C1 is reset by a next reset process. In addition, in the capacitor C2, the electric charge corresponding to the electric potential difference |Vth−Vdata(i)| between the node Nintg (Vintg=Vdata(i)) and the input node Nin (Vin=Vth) is stored (data writing).

In addition, during the data writing period t0 to t1 and the next reset period t1 to t2, the p channel-type transistor T3 which is electrically controlled by the write signal WRT1 is turned off. Therefore, during the period t0 to t2, since a path of the driving current Ioled is not formed irrespective of the level of the output voltage output from the comparator 20, the light is not emitted from the organic EL element OLED.

Continuously, during the reset period t1 to t2, the electric charge stored in the capacitor C1 is reset by the reset voltage Vrst. Specifically, the level of the reset signal RST1 is changed from H level to L level, so that the transistor T4 provided in the comparator 20 is turned off. As a result, the input and output nodes Nin and Nout which are short-circuited are electrically separated from each other, so that the input and output nodes Nin and Nout become a floating state.

In addition, during the period t1 to t2, the voltage of the data line X is changed from the data voltage Vdata(i) to the reset voltage Vrst in a state in which the transistor T1 is turned on while the level of the write signal WRT1 is H level. The reset voltage Vrst is a predetermined voltage which does not depend on the gradation to be displayed. As a result, the voltage Vintg of the integrating node Nintg (hereinafter, referred to as 'an integrating voltage Vintg') is changed from the data voltage Vdata(i) to the reset voltage Vrst according to the voltage change of the data line X. In the capacitor C1, the electric charge corresponding to the electric potential difference |Vrst−Vss| between the integrating node Nintg (Vintg=Vrst) and the Vss terminal is stored. In other words, the electric charge stored in the capacitor C1 is reset to the voltage corresponding to the electric potential difference |Vrst−Vss| not depending on the data voltage Vdata(i), from the voltage corresponding to the electric potential difference |Vdata(i)−Vss| set at the previous process (reset state).

In addition, the input node Nin of the inverter INV is capacitively coupled with the integrating node Nintg through the capacitor C2. Therefore, when the integrating voltage Vintg is changed by |Vrst−Vdata(i)|, the input voltage Vin of the inverter INV is changed by k|Vrst−Vdata(i)|, resulting in Vin=Vth+k (Vrst−Vdata(i)). In the capacitor C2, the electric charge corresponding to the electric charge difference between the integrating node Nintg (Vintg=Vrst) and the input node Nin (Vin=Vth+k (Vrst−Vdata(i)) is stored. Here, the coefficient k is an integer defined by the capacity ratio of the capacitors C1 and C2. The storage data in the capacitor C2 depends on the data voltage Vdata(i), differently from the capacitor C1 (Vth, Vrst and k are integers).

During the reset period t1 to t2, since the value of the input voltage Vin of the inverter INV exceeds the inverted threshold value Vth, the output voltage Vout of the inverter INV becomes L level (=Vss). Therefore, the transistor T2 provided in the middle of the path of the driving current Ioled is turned on. However, during the period t1 to t2, the transistor T3 located at the upper stage of the transistor T2 continuously maintains off-state. Therefore, the path of the driving current Ioled is cut off, so that the organic EL element OLED is not emitted.

In addition, during the driving period t2 to t4, the organic EL element OLED serving as a light-emitting element is allowed to emit light. During the driving period t2 to t4, the write signal WRT1 becomes L level, so that the transistor T1 is turned off and the transistor T3 is turned on. As a result, the driving current Ioled flows in the path from the Vdd terminal toward the Vss terminal through the transistors T3 and T2 and the organic EL element OLED. The driving current Ioled corresponds to the channel current of the transistor T3 and its current level has the gate voltage, that is, the predetermined value which depends on L level of the write signal WRT. Therefore, at the timing t2, the organic EL element OLED starts emitting the light with the predetermined brightness according to the driving current Ioled (predetermined value).

The light emitting of the organic EL element OLED is completed at the timing t3 when the temporally integrated value of the light (its time average corresponds to the brightness perceived by the human) emitted from the organic EL element OLED reaches a predetermined value. In other words, the setting of a gradation to be displayed is performed by controlling a light-emitting time of the organic EL element OLED emitting light with the predetermined brightness if a disturbance factor is not considered. When the organic EL element OLED starts the emitting of the light at the timing t2, the photodiode PTD in the same pixel circuit receives the light emitted from the organic EL element OLED. The photodiode PTD converts the received light into a current to output the photoelectric current Iptd having a level according to the intensity of the light. As a result, the electric charge corresponding to the integral value of the photoelectric current Iptd is discharged by the capacitor C1 having the reset state. In the integral value of the photoelectric current Iptd, the integral voltage Vintg is temporally changed from the Vrst toward Vdata(i) as the integral voltage Vintg changes. In addition, according to the change, the input voltage Vin of the input node Nin which is capacitively coupled with the integrating node Nintg is temporally changed from the Vth+k(Vrst−Vdata(i)) toward the Vth. During the period t2 to t3 when the integral value Vintg reaches the Vdata(i), that is, the input voltage Vin reaches Vth, the level of the output voltage Vout of the inverter INV is L level and the transistor T2 maintains on-state. Therefore, during the period t2 to t3, since the path of the driving current Ioled is continuously formed, the organic EL element OLED continuously emits light. At the timing t3 when the discharge of the capacitor C1 by the photoelectric current Iptd progresses again so that the input voltage Vin reaches the Vth, that is, the integral voltage Vintg reaches the Vdata(i), the level of the output voltage Vout of the inverter INV is changed from L level to H level. As a result, the transistor T2 is switched from on-state to off-state, the path of the driving current Ioled is cut off, and the light emitting of the organic EL element OLED is stopped.

In a case of low gradation, the data voltage Vdata (i) is set to a high value. In this case, the electric potential difference |Vrst−Vdata(i)| decreases and the input voltage Vin changed by temporal integration of the photoelectric current Iptd reaches the Vth relatively fast. Therefore, a timing when the level of the output voltage Vout is changed from L level to H level becomes short, the organic EL element OLED emits light for a short time. On the other hand, in a case of high gradation, the data voltage Vdata (i) is set to a low value. In this case, the electric potential difference |Vrst−Vdata(i)| increases and the input voltage Vin reaches the Vth relatively slowly. Therefore, a timing when the level of the output voltage Vout is changed from L level to H level becomes long, the organic EL element OLED emits light for a long time.

Even in a case of displaying an uniform gradation, a light-emitting brightness in elements is different due to a characteristic or deterioration degree of the organic EL element OLED. According to the present embodiment, by controlling a light-emitting period through optical feedback, the difference in the light emitting brightness is removed. For example, when the deterioration of the organic EL element OLED does not progress so that the light-emitting brightness is high, the photoelectric current Iptd output by the photodiode PTD increases. In this case, as shown by one-dot chain line (a) in FIG. 3, since a changed amount of the integral voltage Vintg is large and the timing t3' reaching the Vintg=Vdata(i) (Vin=Vth) is faster than the timing t3, the light emitting time of the organic EL element OLED becomes short. In addition, when the deterioration of the organic EL element OLED progresses and the light emitting brightness is low, the photoelectric current Iptd output by the photodiode PTD decreases. In this case, as shown by two-dot chain line (b) in FIG. 3, since the changed amount of the integral voltage Vintg is small and the timing t3" reaching the Vintg=Vdata(i) (Vin=Vth) is later than the timing t3, the light emitting time of the organic EL element OLED becomes long. The temporal integration of the light emitting brightness is constant irrespective of the brightness (deterioration situation) of the organic EL element OLED. Therefore, in the case in which the light emitting is stopped at the timing t3 shown by a solid line in FIG. 3, in the case in which the light emitting is stopped at the timing t3' shown by one-dot chain (a) line in FIG. 3 or in the case in which the light emitting is stopped at the timing t3" shown by two-dot chain line (b), the data is displayed with the same gradation in a visional point. In addition, the temporal integration of the light emitting brightness depends on the data voltage Vdata(i) input during the data writing period t0 to t1.

As described above, according to the present embodiment, the photoelectric current Iptd output from the photodiode PTD is integrated by the capacitor C1 connected in parallel to the photodiode PTD. The comparator 20 detects that the integral voltage Vintg where the integral value appears becomes the data voltage Vdata(i) set through the data line X using Vin=Vth, and changes the level of the output signal Vout at the timing t3. The transistor T2 receives an output voltage Vout from the comparator 20 and cuts off a path of the driving current Ioled at the timing t3. According to this configuration, it is possible to ensure uniformity of the display effectively, as compared to the conventional art. According to the present embodiment, although a light-emitting brightness in elements is different due to the characteristic or deterioration degree of the organic EL element OLED, the temporal integration value of the brightness (gradation perceived by the human) in one frame is the same. Therefore, it is possible to effectively reduce an adverse effect that the difference in characteristics of the organic EL element OLED influences an uniformity of the display. In addition, according to the present embodiment, the difference in characteristics of the organic EL element OLED is directly controlled by the data value that the temporal integration of the brightness in the organic EL element OLED is written, it is difficult to be affected by the difference in driving transistors. In addition, according to the present embodiment, there is an advantage in that the photodiode PTD is not used on the region having a bad S/N. With respect to this point, according to the conventional art, a light-emitting brightness is temporally attenuated and the organic EL element OLED emits the light with a low brightness at the time of a low gradation display. For this reason, a light receiving quantity of the photodiode PTD is insufficient, so that the region having a bad S/N needs not be used. According to the present embodiment, the light emitting brightness is constant irrespective of the gradation to be displayed and it is not necessarily required to have a low light emitting brightness at the time of the low gradation display. For this reason, it is possible to achieve the optical feedback type pixel circuit in which the photodiode PTD is used on a region having a good S/N.

In addition, if the data writing period t0 to t1 and the reset period t1 to t2 are sufficiently short for one frame (1F) and there is no difference in displaying even though the organic EL element OLED emits light during those periods, the transistor T3 may be omitted.

Figure 4:
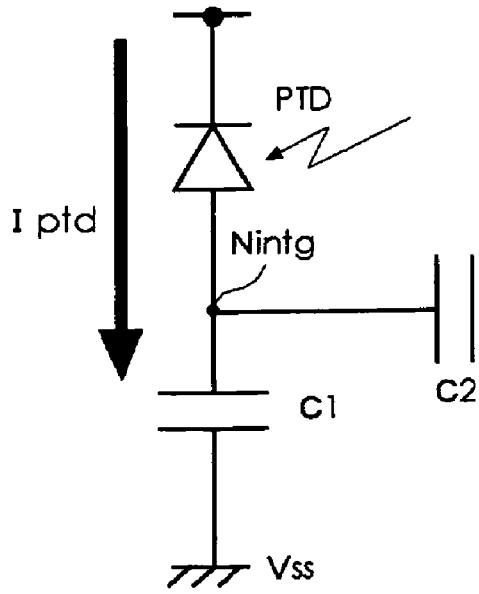
FIG. 4 is a circuit diagram in which a capacitor and a photodiode are connected in series to each other.

According to the present embodiment, an example that a discharge is performed with the photoelectric current Iptd of the photodiode PTD after the photodiode PTD is connected in parallel to the capacitor C1 and the capacitor C1 is firstly reset to a high voltage (the absolute value) is disclosed. However, the present invention is not limited thereto, and the photodiode PTD may be connected in series to the capacitor C1, as shown in FIG. 4. In this case, after the capacitor C1 is firstly reset to the low voltage (absolute value), the charge is performed with the photoelectric current Iptd. In addition, this feature can be applied to the respective embodiments exemplified in the present specification.

Second Embodiment

Figure 5:
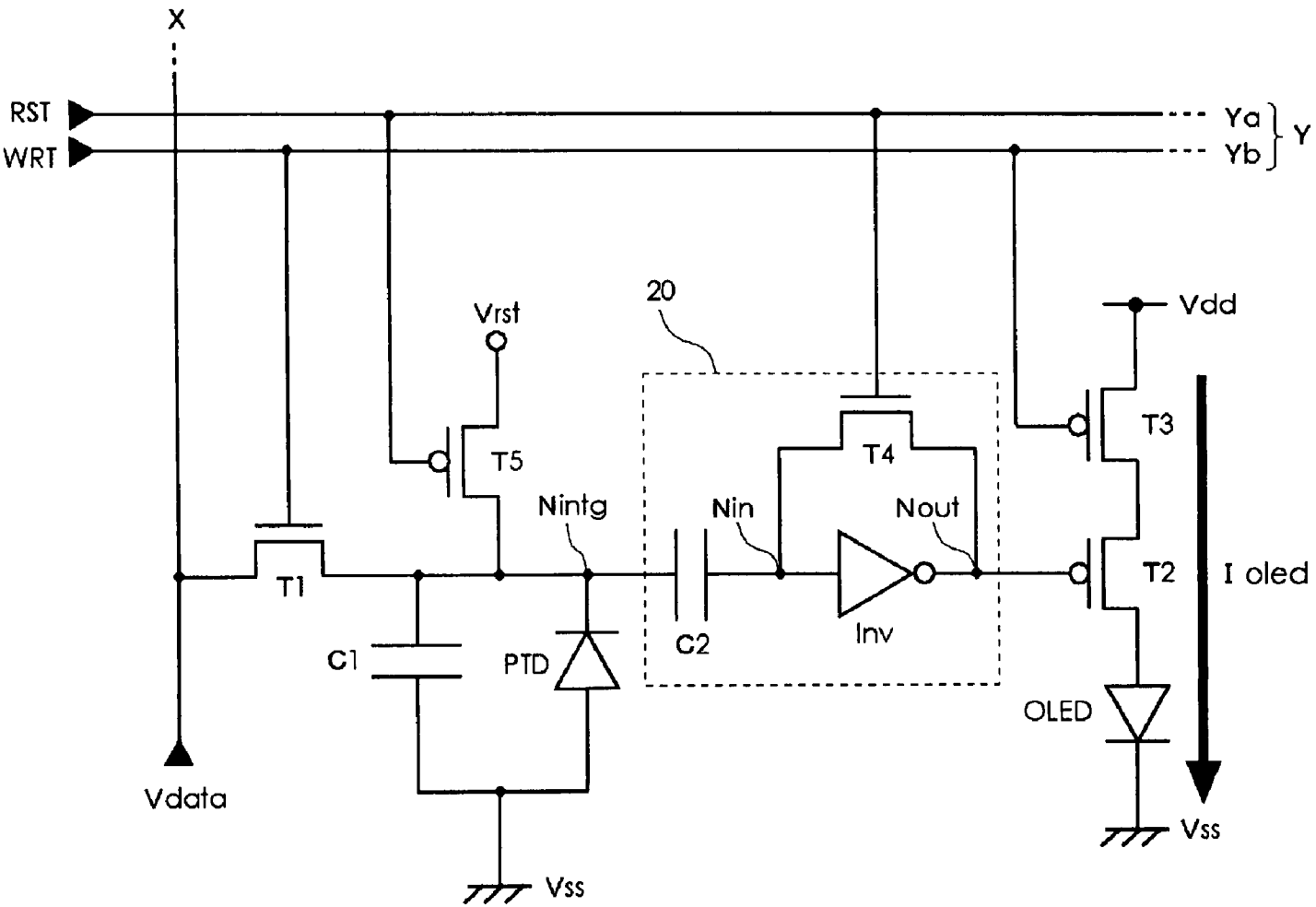
FIG. 5 is a pixel circuit diagram according to a second embodiment of the present invention.

FIG. 5 is a diagram showing an optical feedback type pixel circuit according to a second embodiment of the present invention. The pixel circuit is characterized that a p channel-type transistor T5 electrically controlled through the reset signal RST is additionally provided between the integrating node Nintg and the reset terminal Vrst normally supplied with the reset voltage Vrst. In addition, since the other configuration is the same as that of FIG. 2, the same constituent elements are denoted by the same reference numerals and the descriptions thereof are omitted. The operation of the pixel circuit is basically the same as the timing chart illustrated in FIG. 3.

during the data writing period t0 to t1, since the reset signal RST has H level, the p channel-type transistor T5 is turned off. Therefore, the data writing and the reset of the comparator 20 are performed according to the same process as that in the first embodiment. Subsequently, during the reset period t1 to t2, the level of the reset signal RST falls down from H level to L level, so that the transistor T5 is turned on. During the reset period t1 to t2, the transistor T1 is turned off, and accordingly the data line X and the integrating node Nintg are electrically separated from each other. The reset voltage Vrst is supplied to the integrating node Nintg from the reset terminal Vrst through the transistor T5. As a result, the capacitor C1 connected to the integrating node Nintg is set to the reset state.

According to the present embodiment, the reset voltage Vrst of the capacitor C1 is supplied through a system different from the data line X. As a result, it is possible to improve the flexibility relating to the operation design of the data line driving system, in addition to having the same effect as the first embodiment. Further, the feature of the present embodiment may be applied to the respective embodiments exemplified in the present specification.

Third Embodiment

Figure 6:
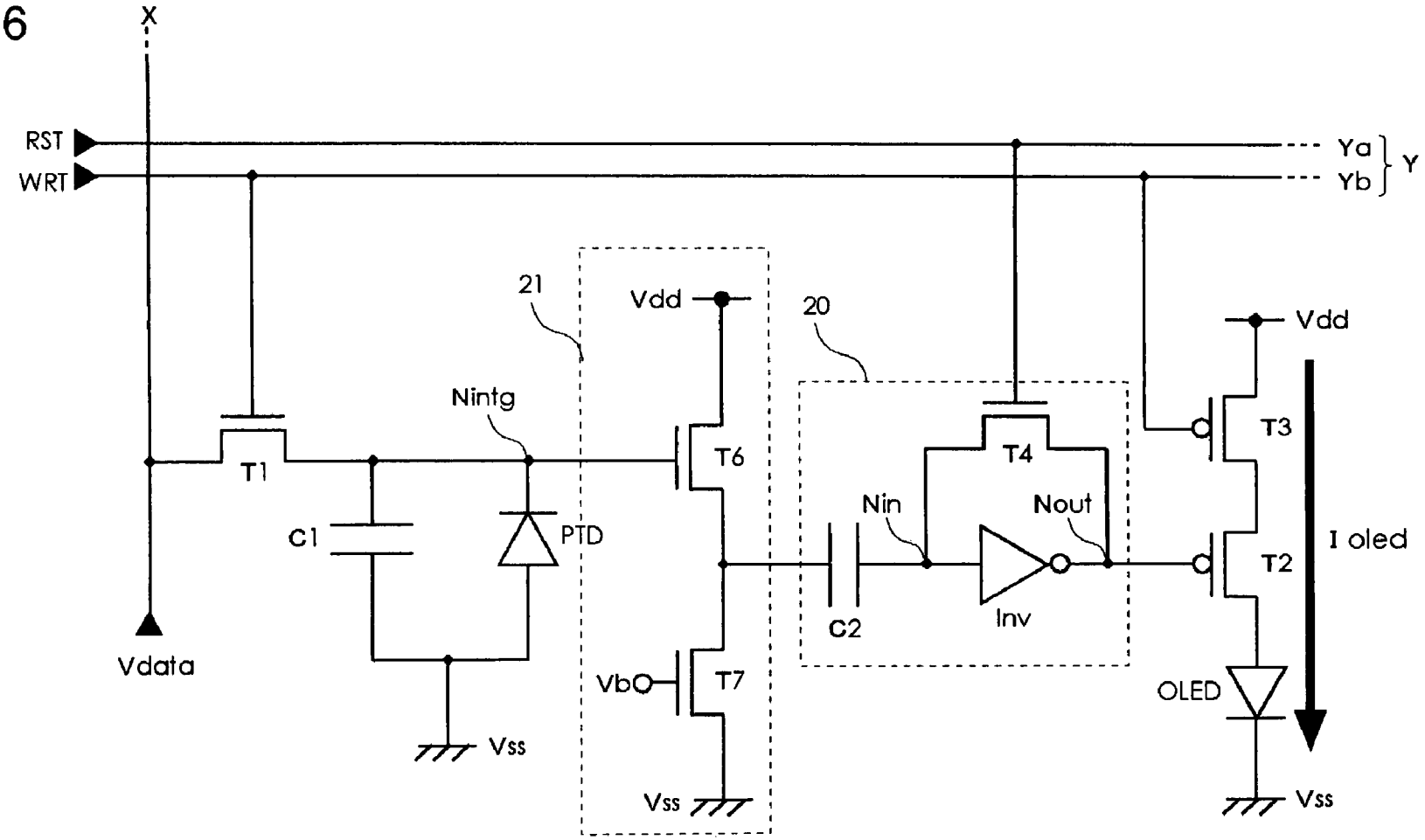
FIG. 6 is a pixel circuit diagram according to a third embodiment of the present invention.

FIG. 6 is a diagram showing an optical feedback type pixel circuit according to a third embodiment of the present invention. The pixel circuit according to the third embodiment is characterized that the third embodiment basically uses the configuration in FIG. 2 and a source follower circuit 20 is additionally provided between the integrating node Nintg and the comparator 20. The source follower circuit 21 includes two n channel-type transistors T6 and T7 connected in series to each other. A gate of the transistor T6 is connected to the integrating node Nintg and one terminal of the transistor T6 is connected to the Vdd terminal. In addition, the other terminal of the transistor T6 is commonly connected to one electrode of the capacitor C1 constituting a part of the comparator 20 and one terminal of the transistor T7. The gate of the transistor T7 is supplied with a predetermined bias voltage Vb and the other terminal of the transistor T7 is connected to the Vss terminal. In addition, since the other configuration is the same as that in FIG. 2, the same constituent elements are denoted by the same reference numerals and the descriptions thereof are omitted.

According to the third embodiment, it is possible to improve operation stability of the pixel circuit by providing the source follower circuit 21 additionally, in addition to having the same effect as the first embodiment. Further, the feature of the present embodiment may be applied to the respective embodiments exemplified in the present specification.

Fourth Embodiment

Figure 7:
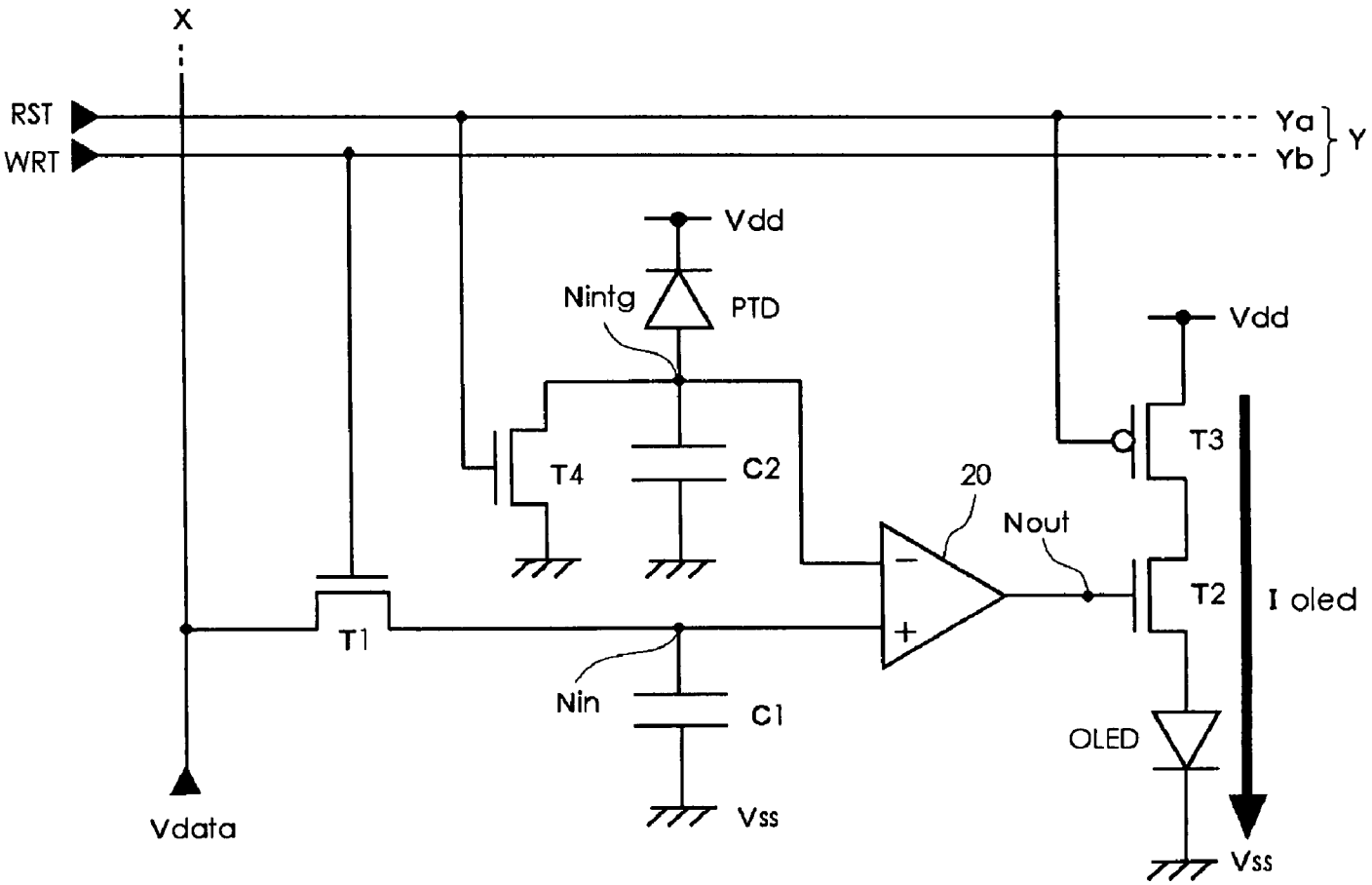
FIG. 7 is a pixel circuit diagram according to a fourth embodiment of the present invention.

FIG. 7 is a diagram showing an optical feedback type pixel circuit according to a fourth embodiment of the present invention. The scanning line Y of one line shown in FIG. 1 corresponds to a set of two scanning lines Ya and Yb shown in FIG. 7. The pixel circuit comprises an organic EL element OLED serving as a light-emitting element, four transistors T1 to T4, two capacitors C1 and C2, a two-input comparator 20 composed of a general operational amplifier, and a photodiode PTD serving as photoelectric transducer. In a configuration in FIG. 7, only the transistor T3 is a p channel-type transistor and the other transistors are n channel-type transistors. However, this configuration is only one example, and other configurations may be used.

A non-inverting input terminal (+terminal) of the comparator 20 is connected to an input node Nin and the input node Nin is commonly connected to one terminal of the transistor T1 serving as a switching element and one electrode of the capacitor C1. A gate of the transistor T1 is connected to the second scanning line Yb supplied with the write signal WRT, and one terminal of the transistor T1 is connected to the data line X supplied with the data voltage Vdata. The other electrode of the capacitor C1 is connected to the Vss terminal. In addition, an inverting input terminal (−terminal) of the comparator 20 is connected to an integrating node Nintg, and the integrating node Nintg is commonly connected to one electrode of the capacitor C2, an anode of the photodiode PTD, and one terminal of the transistor T4 serving as a switching element. A cathode of the photodiode PTD is connected to the Vdd terminal and the other electrode of the capacitor C2 is connected to the Vss terminal. The gate of the transistor T4 is connected to the first scanning line Ya supplied with the reset signal RST and the other terminal of the transistor T4 is connected to the Vss terminal.

An output node Nout of the comparator 20 is connected to the gate of the transistor T2 serving as a switching element. One terminal of the transistor T2 is connected to the anode of the organic EL element OLED, and the other terminal of the transistor T2 is connected to one terminal of the transistor T3 serving as a switching element. The cathode of the organic EL element OLED is connected to the Vss terminal. In addition, the other terminal of the transistor T3 is connected to the Vdd terminal and the gate of the transistor T3 is connected to the first scanning line Ya.

Figure 8:
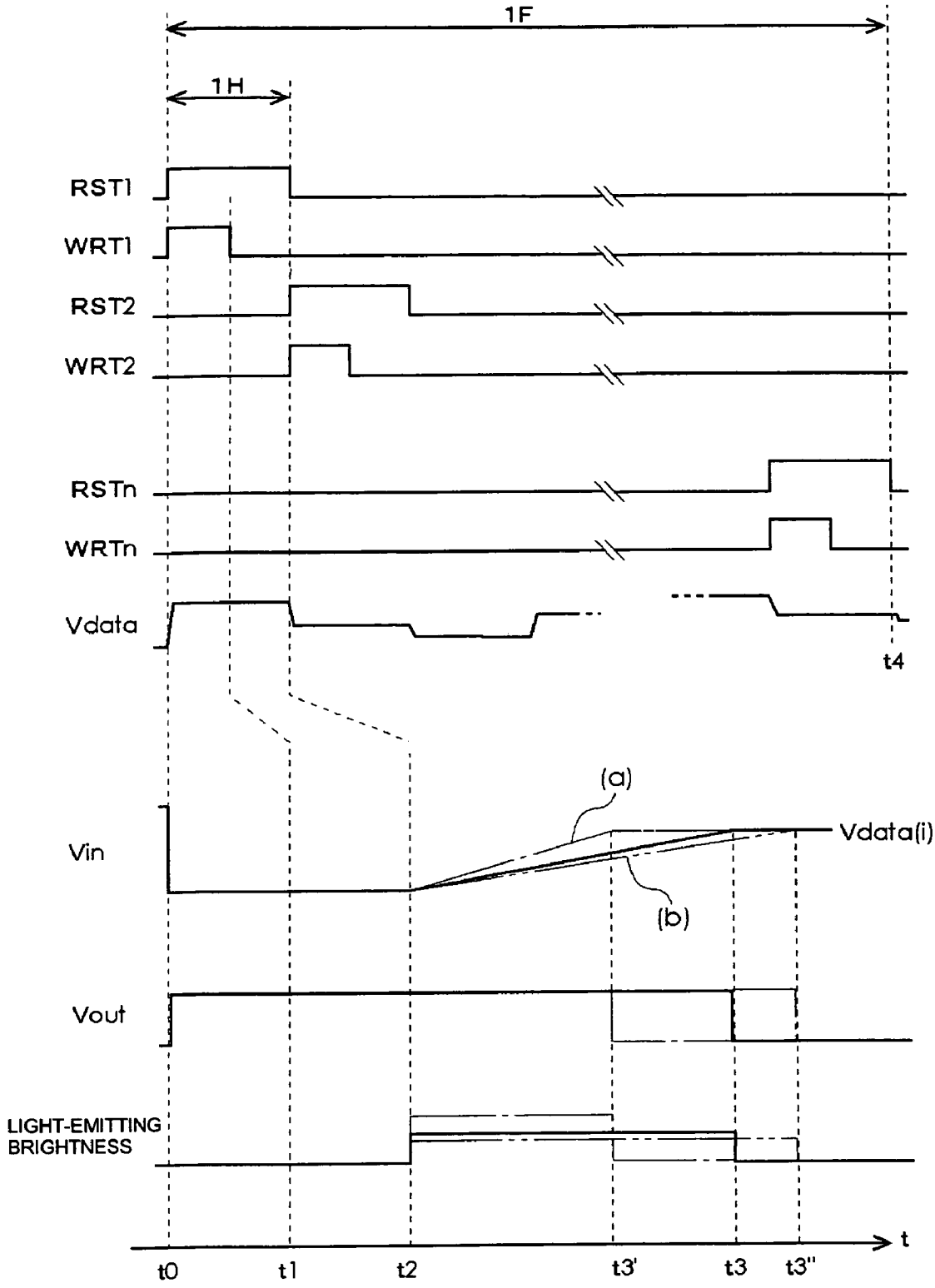
FIG. 8 is an operation timing chart according to a fourth embodiment of the present invention.

FIG. 8 is an operation timing chart of the pixel circuit shown in FIG. 7. Periods t0 to t4 corresponding to the 1F are largely divided into three periods, that is, a data writing period t0 to t1 defined by the write signal WRT1, a reset period t1 to t2 defined by the write signal WRT1 and the reset signal RST1, and a driving period t2 to t4.

First, during the data writing period t0 to t1, the data writing by the capacitor C1 is performed. Specifically, the level of the write signal WRT1 becomes H level and the transistor T1 is turned on. As a result, the data voltage Vdata(i) supplied to the data line X is supplied to the input node Nin, and in the capacitor C1, the electric charge corresponding to the electric potential difference |Vdata(i)−Vss| is stored(data writing). In addition, the level of the reset signal RST1 becomes H level and the transistor T4 is turned on. As a result, the reference voltage Vss is applied to the integrating node Nintg connected to one electrode of the capacitor C1 through the transistor T4 which is turned on, and the electric potential difference in the capacitor C1 is reset to 0. In addition, during the data writing period t0 to t1 and a next reset period t1 to t2, the p channel-type transistor T3 which is electrically controlled through the reset signal RST1 is turned off. Therefore, during the period t0 to t2, since a path of the driving current Ioled is cut off by the transistor T3 irrespective of the output voltage Vout from the comparator 20, the organic EL element OLED does not emit the light.

Subsequently, during the reset period t1 to t2, the level of the write signal WRT1 falls down from H level to L level, so that the transistor T1 is turned off. In the transistor C1, the previously written data is stored. On the other hand, during the period t1 to t2, since the reset signal RST1 maintains H level, the reset state of the capacitor C2 is maintained and the path of the driving current Ioled is cut off.

In addition, during the driving period t2 to t4, the level of the reset signal RST1 falls down from H level to L level, the organic EL element OLED serving as a light-emitting element is allowed to emit the light. Specifically, at the timing t2, since the transistor T3 having off-state is turned off, the output voltage Vout from the comparator 20 has H level, and the transistor T2 also is turned off, a predetermined driving current Ioled is supplied to the organic EL element OLED. As a result, the organic EL element OLED starts emitting light with the predetermined brightness according to the driving current Ioled (predetermined value).

The photodiode PTD provided in the same pixel circuit receives the light emitted from the organic EL element OLED, converts the received light into a current and outputs the photoelectric current Iptd having a level according to the intensity of the light. As a result, the electric charge corresponding to the integral value of the photoelectric current Iptd is charged in the capacitor C1 in the reset state. In the integral value of the photoelectric current Iptd, the integral voltage Vintg temporally changes. During the period t2 to t3 until the integral voltage Vintg reaches the input voltage Vin(=Vdata (i)), the output voltage Vout has H level and the transistor T2 sustains on-state. Therefore, during the period t2 to t3, since a path of the driving current Ioled is formed, the organic EL element OLED continuously emit light. When a charging by the photoelectric current Iptd progresses again so that the integral voltage Vintg reaches the input voltage Vin(=Vdata (i)), the level of the output voltage Vout falls down from H level to L level. As a result, since the transistor T2 is switched from on-state to off-state and accordingly a path of the driving current Ioled is cut off, the emitting light of the organic EL element OLED is stopped.

When deterioration of the organic EL element OLED does not progress so that the light emitting brightness is high, the photoelectric current Iptd output by the photodiode PTD increases. In this case, as shown by one-dot chain line (a) in FIG. 8, since the changed amount of the integral voltage Vintg is large and the timing t3' reaching the Vintg=Vdata(i) is faster than the timing t3, the light emitting time of the organic EL element OLED becomes short. In addition, when the deterioration of the organic EL element OLED progresses and the light emitting brightness is low, the photoelectric current Iptd output by the photodiode PTD decreases. In this case, as shown by two-dot chain line (b) in FIG. 8, since the changed amount of the integral voltage Vintg is small and the timing t3" reaching the Vintg=Vdata(i) is later than the timing t3, the light emitting time of the organic EL element OLED becomes long.

According to the present embodiment, it is possible to ensure uniformity of the display effectively regardless of the characteristics difference or temporal deterioration of the light-emitting element, for the same reason as in the first embodiment.

Fifth Embodiment

Figure 9:
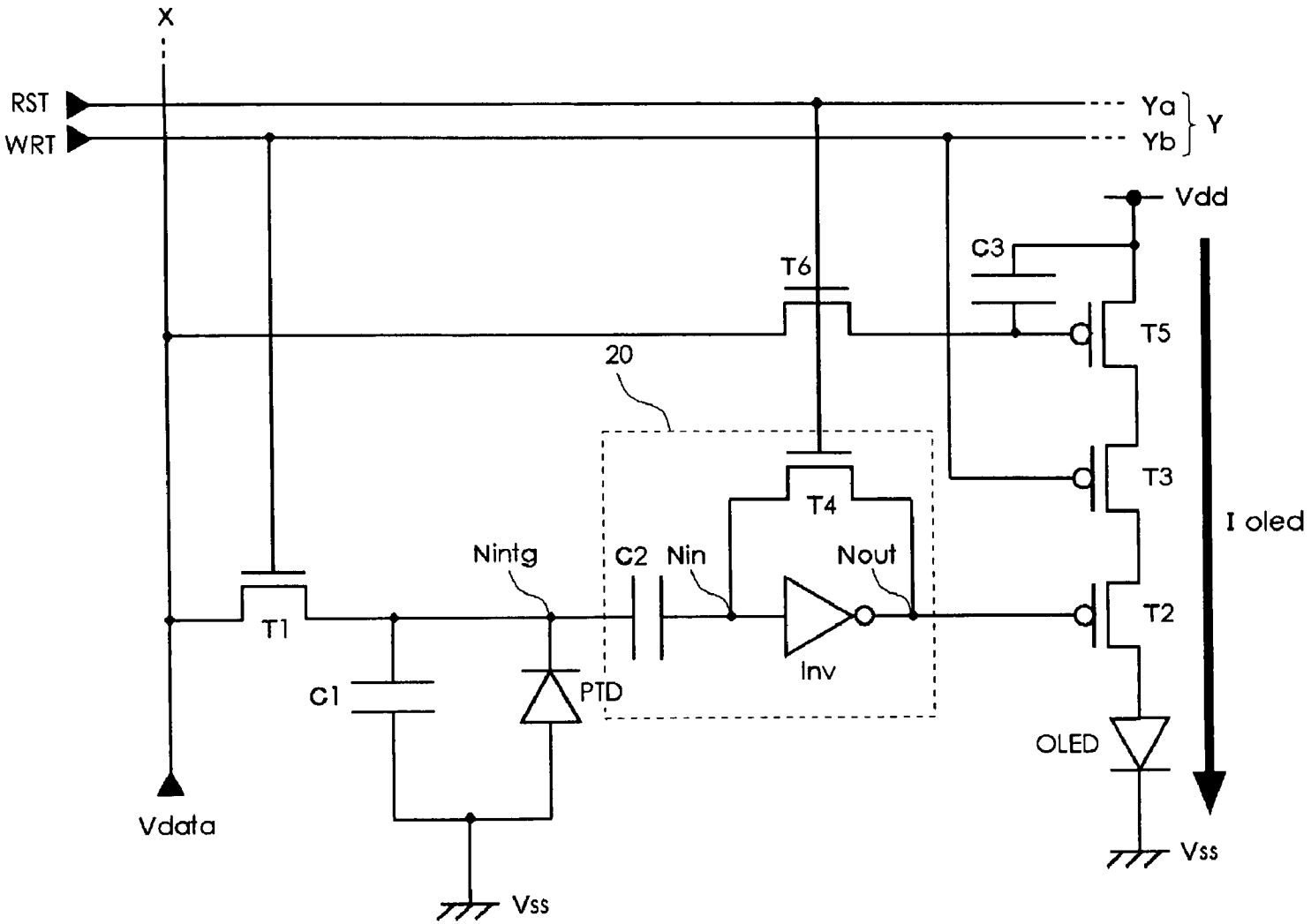
FIG. 9 is a pixel circuit diagram according to a fifth embodiment of the present invention.

FIG. 9 is a diagram showing an optical feedback type pixel circuit according to a fifth embodiment of the present invention. The pixel circuit according to the fifth embodiment is characterized that the pixel circuit shown in FIG. 2 is basically used and a general voltage program type driving system is additionally provided therein. The driving system includes a capacitor C3, a transistor T5 serving as a driving element, and a transistor T6 serving as a switching element. Specifically, one terminal of the transistor T5 is connected to the Vdd terminal and one electrode of the capacitor C3, and the other terminal of the transistor T5 is connected to one terminal of the transistor T3. The gate of the transistor T5 is commonly connected to the other electrode of the capacitor C3 and one terminal of the transistor T6. The other terminal of the transistor T6 is connected to the data line X, and the gate of the transistor T6 is connected to the first scanning line Ya supplied with the reset signal RST, similarly to the transistor T4.

In addition, since the other configuration is the same as that in FIG. 2, the same constituent elements are denoted by the same reference numerals and the descriptions thereof are omitted. The operation of the pixel circuit is basically the same as the timing chart illustrated in FIG. 3.

The capacitor C3 and the transistor T5 serve as means for modulating the driving current Ioled (means for modulating a light-emitting brightness). Specifically, during the data writing period t0 to t1 when a level of the reset signal RST1 becomes H level, the transistor T6 is turned on. As a result, the data voltage Vdata(i) supplied through the data line X is stored in the capacitor C3. In addition, during the driving period t2 to t4 when the level of the write signal WRT becomes L level so that the transistor T3 is turned on, the transistor T5 connected to the capacitor C3 through the gate generates the driving current Ioled to supply it to the organic EL element OLED. The driving current Ioled corresponds to the channel current of the transistor T5 and its current level is set according to the voltage applied to the gate, that is, the storage data in the capacitor C3 for generating the gate voltage.

According to the present embodiment, it is possible to achieve more excellent gradation control than in the first embodiment by additionally providing the voltage program type driving system, in addition to having the same effect as in the first embodiment. According to the first embodiment, when response speed of the comparator 20 is delayed, it becomes difficult to achieve a minute control on a low gradation side. This is because when the gradation becomes low, the light-emitting period becomes short and accordingly pulsed emitting is performed, but the response of the comparator 20 can not cope with it. According to the present embodiment, by combining a modulation of the light-emitting brightness itself with a light-emitting stopping by temporal integration of the light-emitting brightness, it is possible to settle the restriction due to the response delay of the comparator 20 and to achieve the excellent gradation control at the low gradation side.

Sixth Embodiment

Figure 10:
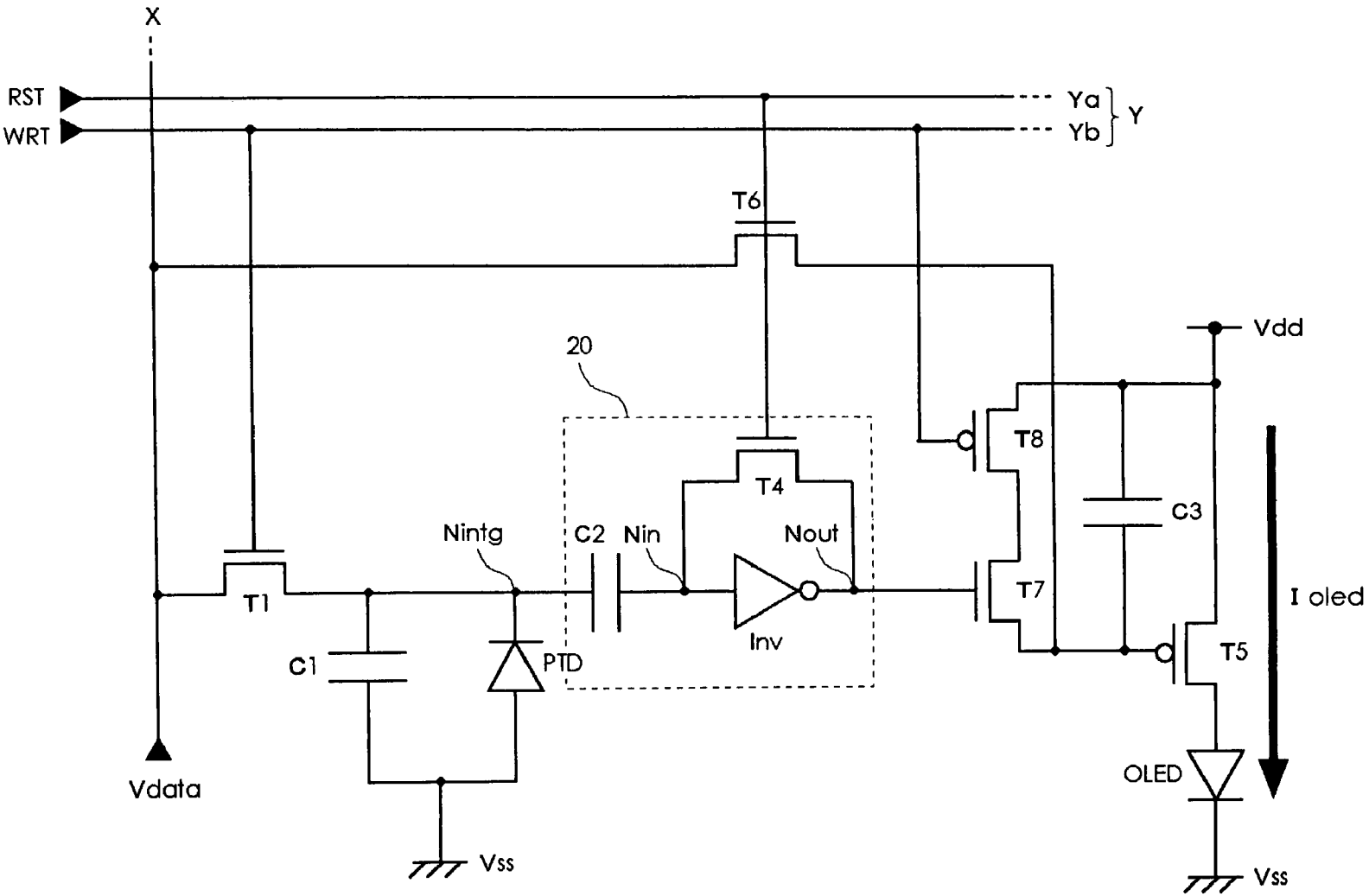
FIG. 10 is a pixel circuit diagram according to a sixth embodiment of the present invention.

According to the above-mentioned embodiments, the examples that light emitting of the organic EL element OLED is stopped by cutting off a path of the driving current Ioled using a switching element is described. However, besides this method, it can be implemented by charging and discharging a storage data in the capacitor C3 shown in FIG. 9 in a non-emitting state. FIG. 10 is a diagram showing an optical feedback type pixel circuit according to a sixth embodiment of the present invention. In addition, since a configuration from the transistor T1 to the output node Nout of the comparator 20 is the same as in the pixel circuit shown in FIG. 9, the same constituent elements are denoted by the same reference numerals and the descriptions thereof are omitted. In addition, the operation of the pixel circuit is basically the same as the timing chart shown in FIG. 3.

One terminal of the transistor T5 serving as a driving element is commonly connected to the Vdd terminal and one electrode of the capacitor C3, and the other terminal of the transistor T5 is connected to the anode of the organic EL element OLED. The cathode of the organic EL element OLED is connected to the Vss terminal. In addition, the gate of the p channel-type transistor T5 is commonly connected to the other terminal of the capacitor C3, one terminal of the n channel-type transistor T6, and one terminal of the n channel-type transistor T7. The other terminal of the transistor T6 is connected to the data line X and the gate of the transistor T6 is connected to the second scanning line Yb supplied with the write signal WRT. The gate of the transistor T7 is connected to the output node Nout to which the output voltage Vout is supplied from the comparator 20, and the other terminal of the transistor T7 is connected to one terminal of the p channel-type transistor T8. The terminal of the transistor T8 is connected to the Vdd terminal and the gate of the transistor T8 is connected to the second scanning line Yb, similarly to the transistor T6.

The capacitor C3 and the transistor T5 serve as means for modulating the driving current Ioled, similarly to the fifth embodiment. Specifically, during the data writing period t0 to t1 when the level of the reset signal RST1 becomes H level, the transistor T6 is turned on. As a result, the data voltage Vdata(i) supplied through the data line X is stored in the capacitor C3. In addition, at the timing t2 when the level of the write signal WRT becomes L level so that the transistor T8 is turned on, the transistor T5 connected to the capacitor C3 through the gate generates the driving current Ioled according to the storage data in the capacitor to supply it to the organic EL element OLED. As a result, the organic EL element OLED starts emitting the light. During the light emitting period t2 to t3, since the level of the output voltage Vout is L level, the transistor T7 connected in parallel to the capacitor C3 is turned off, so that it makes a pair of electrodes of the capacitor C3 electrically separated from each other. As shown in FIG. 3, the light emitting of the organic EL element OLED is stopped at the timing t3 when the level of the output voltage Vout from the comparator is changed from L level to H level. The reason is that, at the timing t3, since the transistor T7 connected in parallel to the capacitor C3 is turned on so that the pair of electrodes of the capacitor C3 is short-circuited, the storage data in the capacitor C3 is discharged.

According to the present embodiment, the organic EL element is set such that, by providing a voltage program type driving system, the organic El element enters into a non-emitting state at the timing t3 when the output voltage Vout changes the storage data in the capacitor C3 constituting the driving system. As a result, the same effect as the fifth embodiment is obtained.

In addition, according to the respective embodiments, the case in which an organic EL element OLED is used as a light-emitting element is exemplified. However, the present invention is not limited thereto, and may be applied to a light-emitting element (an inorganic LED display device, a field emission display device or the like) or an electro-optical device (an electrochromic display device, an electrophoresis display device or the like) having a transmittance and reflectance according to a driving current.

Figure 12:
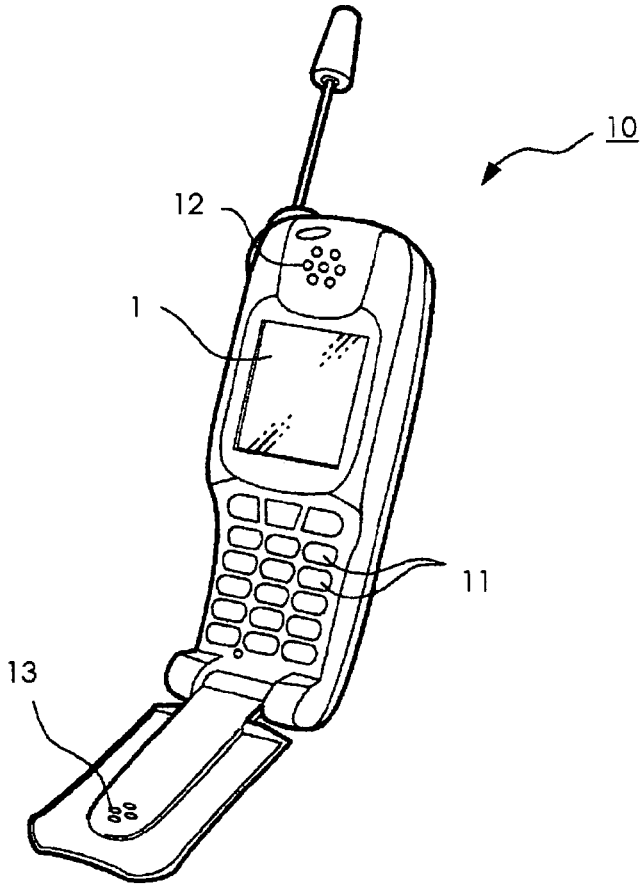
FIG. 12 is an external perspective view of a mobile phone having an electro-optical device.

In addition, the electro-optical device according to the above-mentioned embodiments can be mounted on various electronic apparatuses including a TV, a projector, a mobile phone, a PDA, a portable computer and a personal computer. FIG. 12 is an external perspective view of a mobile phone 10 on which the electro-optical device according to the above-mentioned embodiments is mounted. The mobile phone 10 includes an earpiece 12, a mouthpiece 13 and the above-mentioned display unit 1 in addition to a plurality of operation buttons 11. If the electro-optical device is mounted on these electronic apparatuses, it is possible to further enhance commercial value of the electronic apparatuses and to raise purchasing power of the electronic apparatuses in the market.

What is claimed is:

1. A pixel circuit comprising:

a light-emitting element for emitting light according to a driving current supplied through a predetermined path;

a photoelectric transducer for receiving the light emitted from the light-emitting element to output a photoelectric current according to the received light;

a first capacitor for storing as an electric charge the integral value of the photoelectric current output from the photoelectric transducer;

a comparator for changing a level of an output voltage at a timing when a first voltage set according to the electric charge stored in the first capacitor reaches a second voltage set according to data supplied through a data line;

a first switching element electrically controlled according to the output voltage output from the comparator for making the light-emitting element emit the light when the first voltage has not reached the second voltage and for making the light-emitting element stop emitting the light when the first voltage reaches the second voltage;

a second capacitor for storing the data supplied through the data line; and a driving transistor having its gate connected to the second capacitor for generating the driving current according to the data stored in the second capacitor;

wherein the first switching element is provided in parallel with the second capacitor, to electrically separate a pair of electrodes of the second capacitor from each other when the first voltage has not reached the second voltage and to electrically connect the pair of electrodes of the second capacitor to each other when the first voltage reaches the second voltage.

2. The pixel circuit according to claim 1, wherein the first switching element is provided in the middle of a path for supplying a driving current to the light-emitting element, to form the path of the driving current when the first voltage has not reached the second voltage and to cut off the path of the driving current when the first voltage reaches the second voltage.

3. The pixel circuit according to claim 1, further comprising:

a second switching element provided between a node to which the photoelectric transducer and the first capacitor are commonly connected and a voltage terminal supplied with a predetermined reset voltage, and for resetting the electric charge stored in the first capacitor using the reset voltage.

4. The pixel circuit according to claim 1, further comprising:

a source follower circuit provided between a node to which the photoelectric transducer and the first capacitor are commonly connected and an input node of the comparator.

5. An electro-optical device comprising:

a plurality of scanning lines;

a plurality of data lines;

a plurality of pixel circuits provided at intersections of the plurality of scanning lines and the plurality of data lines;

a scanning line driving circuit for sequentially selecting the plurality of scanning lines; and a data line driving circuit operating in conjunction with the scanning line driving circuit for outputting a data voltage to the plurality of data lines, wherein the pixel circuit is the pixel circuit according to claim 1.

6. An electronic apparatus having the electro-optical device according to claim 5.

7. A method of driving a pixel circuit comprising:

a first step comprising:

supplying a driving current to a light-emitting element through a predetermined path to make the light-emitting element emit light;

writing data supplied through the data line in a second capacitor;

modulating the driving current according to the data stored in the second capacitor; and supplying the modulated driving current to the light-emitting element through a predetermined path to make the light-emitting element emit the light;

a second step of receiving the light emitted from the light-emitting element to output a photoelectric current according to the received light from a photoelectric transducer;

a third step of storing as an electric charge in a first capacitor the integral value of the photoelectric current output from the photoelectric transducer;

a fourth step of changing the level of an output voltage output from a comparator at a timing when a first voltage set according to the electric charge stored in the first capacitor reaches a second voltage set according to data supplied through a data line; and a fifth step comprising:

controlling, electrically, a first switching element according to the output voltage output from the comparator, to make the light-emitting element emit the light when the first voltage has not reached the second voltage and to make the light-emitting element stop emitting the light when the first voltage reaches the second voltage;

separating, electrically, a pair of electrodes of the second capacitor from each other by turning off the first switching element when the first voltage has not reached the second voltage; and connecting, electrically, the pair of electrodes of the second capacitor to each other by turning on the first switching element when the first voltage reaches the second voltage;

wherein the first switching element is provided in parallel with the second capacitor.

8. The method of driving a pixel circuit according to claim 7, wherein the first switching element is provided in the middle of a path for supplying a driving current to the light-emitting element, and the fifth step comprises:

a step of forming the path of the driving current by turning on the first switching element when the first voltage has not reached the second voltage; and a step of cutting off the path of the driving current by turning off the first switching element when the first voltage reaches the second voltage.

* * * * *